United States Patent [19]

Engleman

[11] 4,256,084

[45] Mar. 17, 1981

[54] DEVICE FOR SUPPLYING OUTSIDE COMBUSTION AIR TO A FIREPLACE

[76] Inventor: Elmer F. Engleman, 3615 Mt. Pleasant Rd., Kelso, Wash. 98626

[21] Appl. No.: 105,128

[22] Filed: Dec. 19, 1979

Related U.S. Application Data

[63] Continuation-in-part of Ser. No. 914,378, Jun. 12, 1978, abandoned.

[51] Int. Cl.[3] ..... F24J 3/02

[52] U.S. Cl. ..... 126/121; 126/139

[58] Field of Search ..... 126/160, 121, 123, 140, 126/141, 143, 138, 202, 120, 112

[56] References Cited

U.S. PATENT DOCUMENTS

| | | | |
|---|---|---|---|
| 2,470,430 | 5/1949 | Carter | 126/143 |
| 3,452,737 | 7/1969 | Pellegrino et al. | 126/121 |
| 3,913,558 | 10/1975 | Caldwell | 126/140 |
| 3,976,048 | 8/1976 | Ashman, Jr. | 126/143 |
| 4,059,091 | 11/1977 | Cobb | 126/140 |
| 4,061,127 | 12/1977 | Fisher | 126/140 |
| 4,068,649 | 1/1978 | Joanson | 126/143 |
| 4,129,113 | 12/1978 | Bergstrom | 126/121 |

FOREIGN PATENT DOCUMENTS

| | | | |
|---|---|---|---|
| 868581 | 5/1961 | United Kingdom | 126/143 |

*Primary Examiner*—James C. Yeung
*Assistant Examiner*—Larry Jones
*Attorney, Agent, or Firm*—Klarquist, Sparkman, Campbell, Leight, Hall & Whinston

[57] ABSTRACT

Outside combustion air is directed through a conduit into a special manifold positioned on the hearth of an existing fireplace. The manifold extends laterally across the fireplace opening and is positioned to block passage of inside room air through plural air supply slots in a door framework which lead to the firebox of the fireplace. In one form, a channel member secures the upper portion of the manifold to the door framework. In another form, plural mounting brackets attach the manifold to the framework such that the weight of the manifold causes a seal carried by the manifold to bear against the framework and substantially seal the space between the manifold and framework.

1 Claim, 9 Drawing Figures

DEVICE FOR SUPPLYING OUTSIDE COMBUSTION AIR TO A FIREPLACE

This application is a continuation-in-part of co-pending application Ser. No. 914,378, filed June 12, 1978 now abandoned.

BACKGROUND OF THE INVENTION

1. Field of the Invention

The present invention relates to a device for supplying outside combustion air to an existing fireplace while preventing inside room air from passing up the fireplace flue.

2. Description of the Prior Art

Previously, fireplaces have been constructed with complex conduits and other devices built into the fireplace structure for supplying the fireplace with outside combustion air. An example of such a device is shown in U.S. Pat. No. 3,976,048 of Ashman. A common drawback of all of these known devices is that an existing fireplace would have to be rebuilt at great cost and inconvenience, before it could incorporate one of these known devices. Consequently, these existing fireplaces use heated inside room air during combustion. As a result, energy is wasted in that this heated room air flows up the flue during burning and is lost.

Therefore, a need exists for a simple, easily installable device for supplying outside combustion air to existing fireplaces so as to make them more energy efficient.

SUMMARY OF THE INVENTION

It is a primary object of my invention to provide an improved device for supplying outside combustion air to the firebox of a fireplace to eliminate the need for using heated room air during combustion.

It is another object of my invention to provide a device for converting existing fireplaces which utilize combustion air from a room to utilize outside combustion air.

A further object of my invention is to provide such a device which is of simple construction and easy to manufacture.

Another object of my invention is to provide such a device which is portable, thereby making it easily transferrable from one fireplace to another.

Still another object of the invention is to provide a relatively inexpensive outside combustion air supplying device which is easily installable by a homeowner.

A still further object of the invention is to provide an outside combustion air supplying device with improved sealing to reduce the entry of combustion air from a room into a fireplace.

Other objects, as well as features and advantages of the present invention, will become more apparent from the following detailed description which proceeds with reference to the accompanying drawings.

DETAILED DESCRIPTION OF THE PREFERRED EMBODIMENTS

Figure 1:
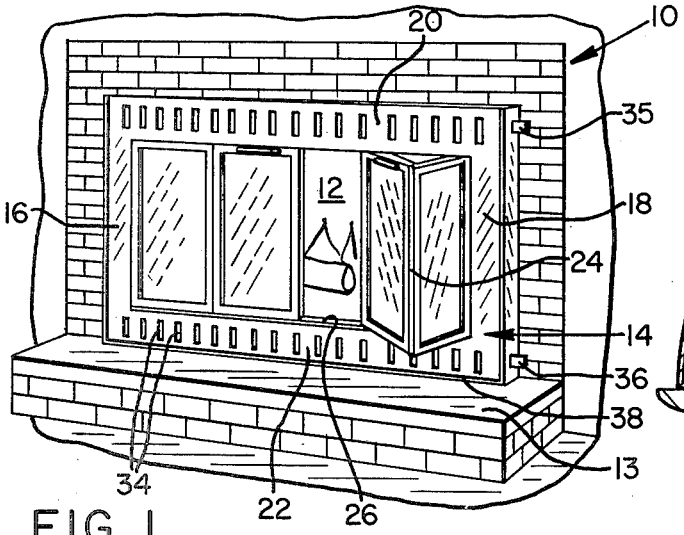
FIG. 1 is a front perspective view of a conventional fireplace.
Figure 4:
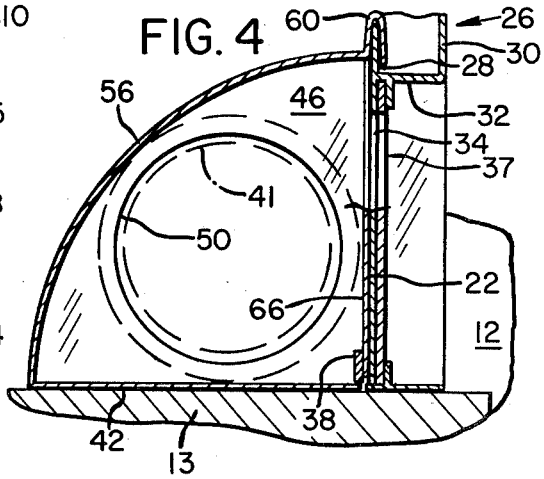
FIG. 4 is a cross-sectional view taken along lines 4—4 of FIG. 3.

Referring to FIG. 1, a conventional fireplace 10 includes a firebox or combustion chamber 12 in which logs and other fuel is burned. The firebox 12 opens at its front toward a hearth 13. The hearth in turn extends into a room inside a building in which the fireplace is located. The firebox opening is surrounded by a framework 14 comprised of a pair of vertical side rails 16, 18 and horizontal upper and lower rails 20, 22. Bi-fold doors 24 are supported by framework 14 and operate to open and close the firebox opening. The doors 24 have a downwardly projecting peg, not shown, which slides within a track 26 along the upper edge of rail 22 when the doors are operated. As shown in FIG. 4, track 26 is generally U-shaped with a pair of spaced-apart vertical leg flanges 28, 30 joined by a connecting base portion 32.

Upper and lower rails 20, 22 each include a plurality of air supply apertures or slots, some being numbered 34, which extend between the room and the firebox. During normal operation, with doors 24 closed, combustion air passes from the room through these slots and into firebox 12. Push-pull bars 35, 36 at the ends of respective rails 20, 22 operate a conventional damper sliding mechanism for controlling the amount of air passing through the slots 34 of each rail. One such sliding mechanism 37 is shown in FIG. 4 and operated by bar 36. A band of ornamental metal 38 is typically provided along the lower edge of rail 22.

Figure 2:
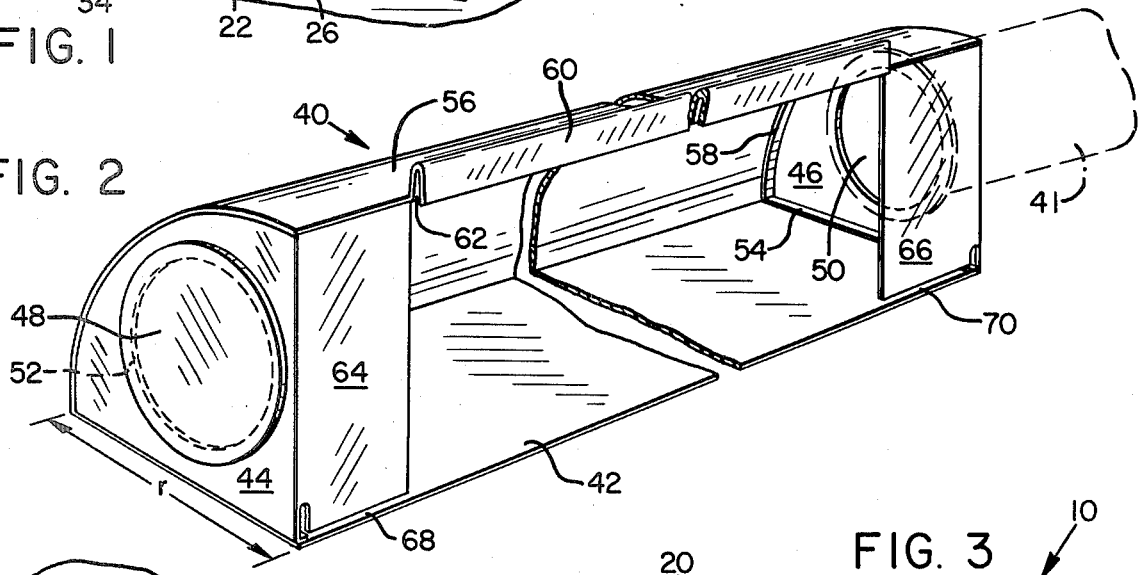
FIG. 2 is a rear perspective view of a manifold in accordance with the present invention.

Referring to FIG. 2, the present invention includes a special manifold 40 designed for attachment to lower rail 22 of framework 14 so as to block the entry of room air through slots 34 of this rail. Combustion air from outside the building is supplied to this manifold through a conduit 41 and thence passes into firebox 12. Consequently, fireplace 10 is converted into a more efficient heating device in that heated air from the room is not drawn into the fireplace and lost up the fireplace flue during combustion.

Manifold 40 includes a planar base plate portion 42 for resting on the upper surface of hearth 13. In addition, the manifold includes a pair of spaced apart end plates 44, 46 projecting vertically upwardly from the respective outer ends of base portion 42. These end plates are each in the shape of a quarter of a circle of radius r having a center at the inner edge of base 42. In addition, a lip 54 is provided at the lower edge of the end plates for fastening, as by welding, to base 42. End plate 46 has an outside air-receiving opening 50 to which the conduit 41, shown in dashed lines, is attached. The interior of manifold 40 is connected by conduit 41 to the exterior of the building for bringing outside combustion air into the manifold. Similarly, end plate 44 also includes an outside air-receiving opening 48 which is normally covered by a snap-fit plug 52. Opening 48 provides a connecting point to which another conduit may be connected should it be desired to supply additional outside combustion air to the manifold. In addition, conduit 41 can be connected to opening 48 with opening 50 plugged in the event it is desired to alternately feed outside combustion air to this end of the manifold.

A curved covering section 56 in the shape of a quarter of a cylinder of radius r is connected to the outer edges of end plates 44, 46 and of base 42. Thus, covering section 56 lies in the area traced out by a line rotated about the inner edge of base 42 at a distance r from this edge. To facilitate fastening of covering portion 56 in position, a lip 58 is provided along the outer edge of the end plates to which the covering may be welded. Also, an inverted U-shaped channel member 60 having a downwardly opening channel 62 is provided along the upper surface of covering portion 56. As explained below, when the manifold is positioned on the hearth, channel 62 slidably receives a portion of track 26 so that the manifold is releasably secured to framework 14.

Manifold 40 also includes a side wall portion including a pair of spaced apart rectangular side plates 64, 66. Plate 64 extends perpendicularly inwardly from the inner vertical edge of end plate 44 toward plate 66 while plate 66 extends perpendicularly inwardly from the inner edge of end plate 46 toward plate 64. The upper edge of each of these plates is connected to the upper edge of covering member 56 and the lower edge of these plates is spaced apart from the base portion 42 to form respective band receiving slots 68, 70. A rectangular air passage is thus provided through the wall portion and defined at its sides by the inner edges of side plates 64, 66 at its bottom by a portion of the inner edge of base 42, and along its top by a portion of the upper edge of covering 56. Channel member 60 extends from side to side of this passage.

Base 42 and covering section 56 are preferably fabricated from one rectangular piece of sheet metal which is folded at the intersection of the covering section and base. In addition, channel 60 can be formed from the same piece by bending the upper edge of covering 56. Furthermore, each end plate 44, 46 its lips 54, 58 and its respective side plate 64, 66 is preferably formed from one piece of sheet metal. Therefore, the manifold 40 is easy to manufacture in that only three pieces of sheet metal are required.

Figure 3:
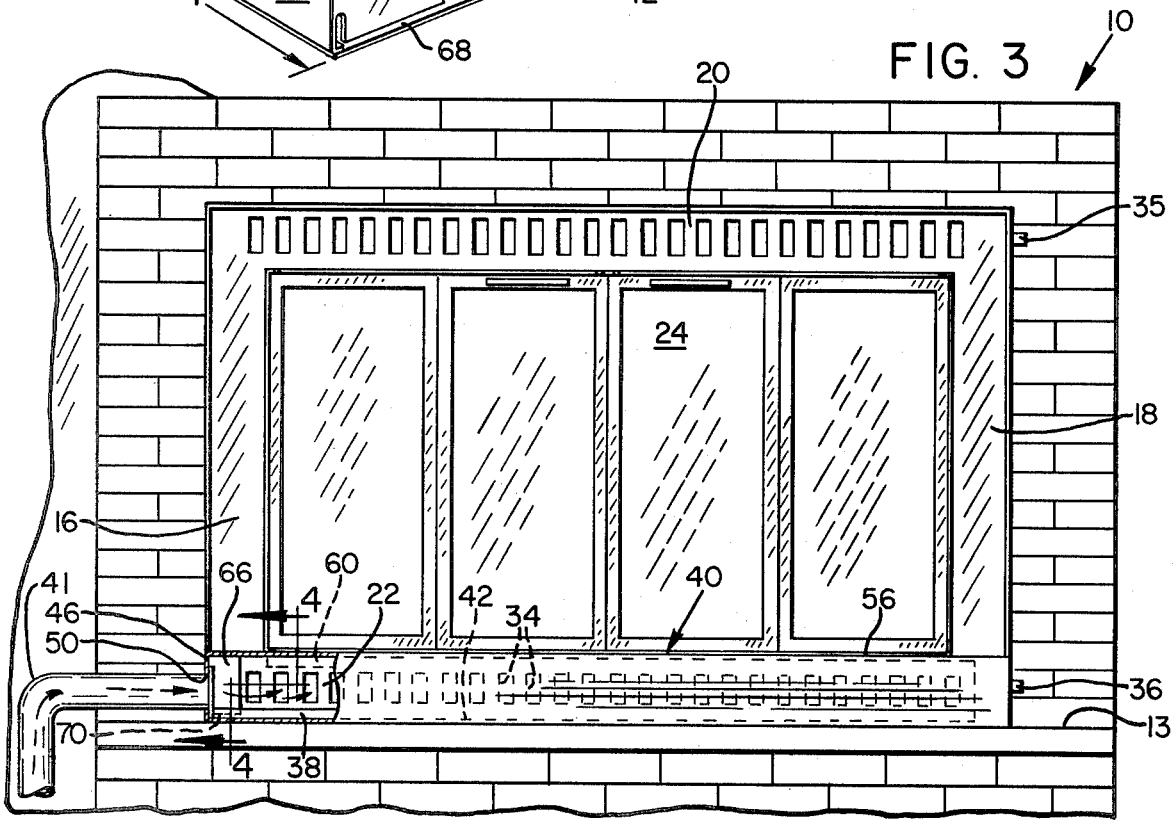
FIG. 3 is a front elevation view of the fireplace of FIG. 1 equipped with an outside air coupling device in accordance with the present invention.
Figure 5:
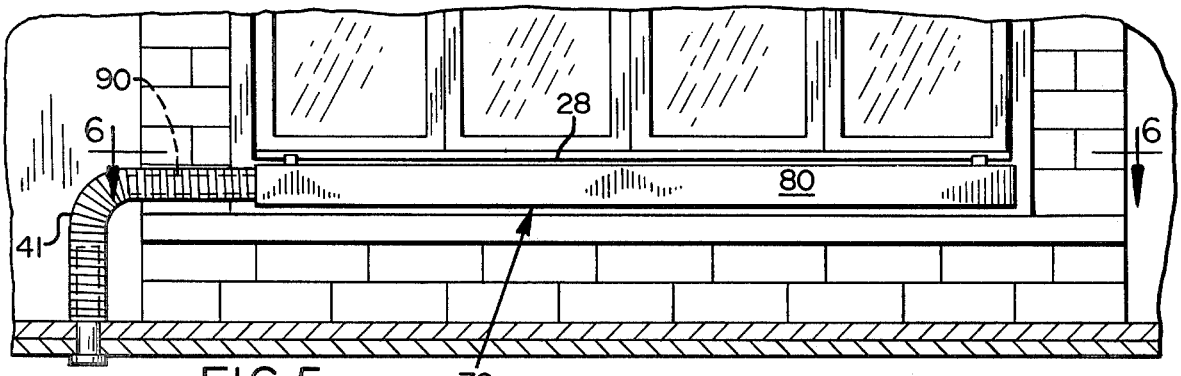
FIG. 5 is a front elevation view of another embodiment of outside combustion air supplying device in accordance with the present invention.
Figure 6:
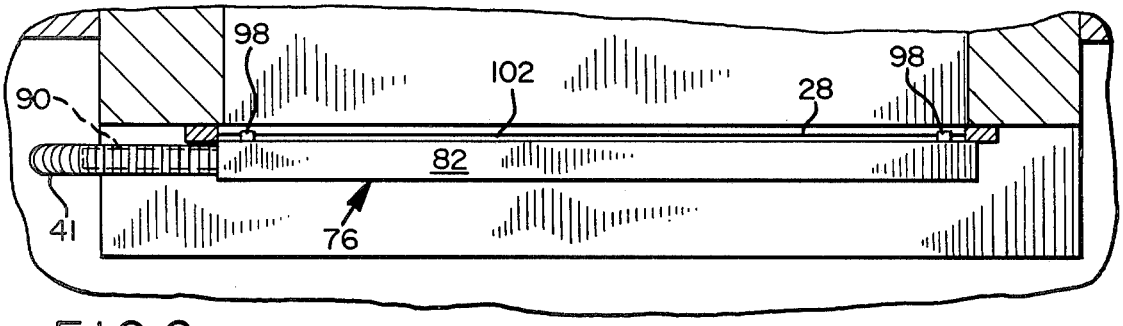
FIG. 6 is a top plan view of the outside combustion air supplying device of FIG. 5.

To install the manifold, as shown in FIGS. 3 and 4, channel 62 receives leg flange 28 of track 26. At the same time, the lower portion of each side plate 64, 66 is inserted between the band 38 and lower rail 22. Consequently, the manifold is rigidly secured in position on the hearth. When in position, inside room air is blocked by the manifold from entering the slots 34 through rail 22 and the slots of the upper rail can be closed using bar 35. Sealing of the top of the passage through the side wall portion is enhanced by the cooperation of leg flange 28 and channel member 60. As a result, heat loss due to inside room air leaving through the chimney of the fireplace is reduced.

FIGS. 5 through 9 illustrate another form of special manifold 76 designed for attachment to lower rail 22 of framework 14 so as to block the entry of room air through slots 34 of this rail. Combustion air from outside the building is supplied to this manifold through a conduit 41 and thence passes into firebox 12. Therefore, like manifold 40, manifold 76 converts fireplace 10 into a more efficient heating device as warm air from the room is not drawn into the fireplace and lost.

Manifold 76 is elongated so that, when mounted, it extends substantially along the length of the fireplace opening sufficiently to cover all of the air supply apertures 34 through the lower rail. In the illustrated form, manifold 76 is generally box-like having a rectangular rear wall 78, front wall 80, and top and bottom walls 82, 84. End walls 86, 88 close the respective ends of the manifold. Each of these walls is suitably of metal and thus is rigid for durability.

End plate 88 defines a circular opening through which a coupling conduit 90 is inserted. Conduit 90 has an annular flange 92 (FIG. 7) which abuts the interior surface of end wall 88 when the conduit is in position. The conduit is secured in place in a suitable manner, as by welds 94 or by a screw (not shown) which engages flange 92. In the preferred embodiment, conduit 90 is of one and one-half inch outside diameter and is of a light weight thin-walled metal. Conduit 90 is inserted within air supply conduit 41 to provide an air tight friction seal between these members.

Wall 78 has an exposed flat surface adapted for positioning adjacent lower rail 22. Plural air supply openings 96 are provided through wall 78 and, when the manifold is in position, communicate through apertures 34 to the firebox to provide a passageway for outside combustion air through conduits 41, 90, manifold 76, openings 96, apertures 34 and into the firebox.

A hook or mounting bracket 98 is secured to wall 78, as by a bolt 100 (FIG. 8), adjacent each end of manifold 76. Brackets 98 engage leg flange 28 of track 26 and suspend the manifold in operating position. Manifold 76 is sized to have a height less than the height of lower rail 22, for example two and one-half inches is often suitable, so that the manifold is not supported by the fireplace hearth and yet encloses apertures 34. With this mounting, the center of gravity of the manifold acts through a vertical plane which is spaced from a horizontal axis through the connection of brackets 98 to the framework. As a result, the manifold tends to pivot about this axis with wall 78 moving toward lower rail 22. Also, a semi-rigid somewhat compressible heat resistant seal or gasket 102 is positioned between wall 78 and lower rail 22 to substantially seal the space between apertures 34 and air supply openings 96 when the manifold is in position. Preferably, seal 102 is mounted to wall 78 along its perimeter so that, as wall 78 pivots toward lower rail 22, seal 102 engages the lower rail 22. Seal 102 compresses somewhat as it engages the lower rail to enhance the seal. Also, seal 102 abuts lower rail 22 to limit the pivoting of the manifold. As a result, when manifold 76 is mounted the gasket 102 bears against the adjacent surface of lower rail 22 and enhances the sealing between the manifold and rail. Consequently, leakage of inside room air into the firebox is reduced and a more efficient heating device is produced.

Figure 7:
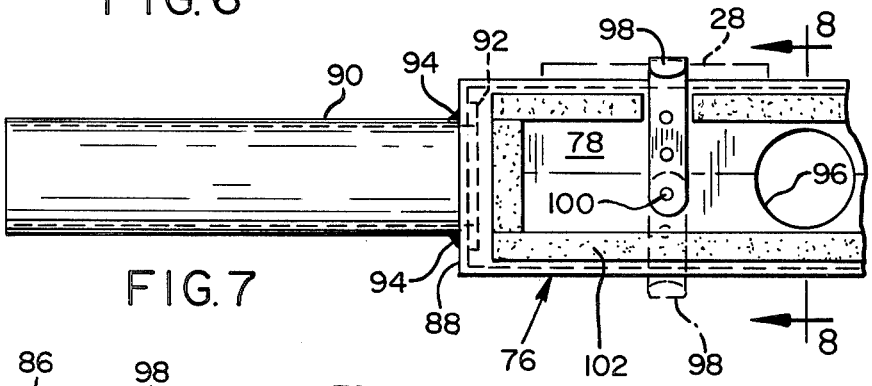
FIG. 7 is a rear elevation view of a portion of the device of FIG. 5.
Figure 8:
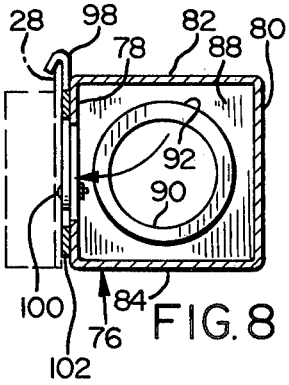
FIG. 8 is a cross-sectional view taken along lines 8—8 of FIG. 7.
Figure 9:
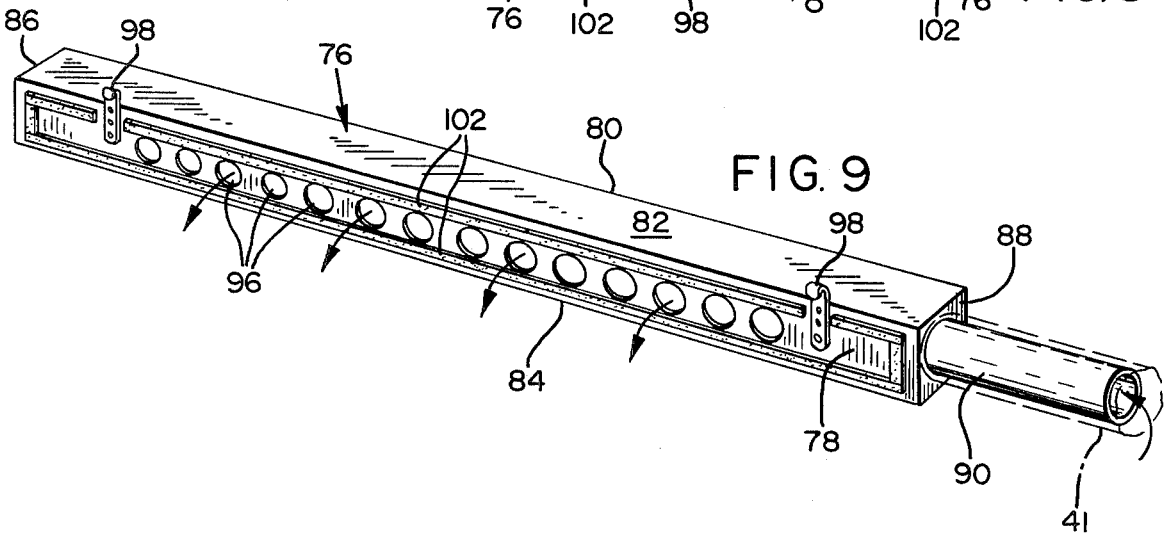
FIG. 9 is a rear perspective view of the device of FIG. 5.

Also, by reversing brackets 98, as shown in phantom in FIG. 7, manifold 76 can be mounted with wall 84 on top. This causes conduit 90 to project in the opposite direction from that shown in FIG. 5 so that outside combustion air can be supplied from a conduit 41 located at this side of the fireplace as desired.

In addition, each form of manifold can readily be removed from the fireplace by disconnecting conduit 41 and lifting the mainfold upwardly from the hearth.

Therefore, the manifolds are portable so that they can readily be moved from one fireplace to another if desired.

Furthermore, the outside air supplying apparatus of this invention can be installed without the need for expensive modifications of an existing fireplace. As a result conversion of existing fireplaces to use outside combustion air can be easily implemented.

Having illustrated and described the principles of my invention with reference to preferred embodiments, it should be apparent to those persons skilled in the art that such invention may be modified in arrangement and detail without departing from such principles.

I claim:

1. A device for supplying outside combustion air to a fireplace having a hearth, and firebox with an opening accessible from an inside room, a framework surrounding the opening for supporting a door which is operable to open and close the opening, said framework including a lower rail portion having at least one air supply aperture communicating between the inside room and the firebox, and a door track portion said device comprising:

a manifold extending generally laterally of said opening, said manifold including a wall positioned adjacent to the lower rail of the framework and defining an air passage therethrough positioned such that air is permitted to pass from the interior of said manifold through the passage and the aperture and into the firebox;

support means for supporting said manifold from the framework;

sealing means positioned between said wall and said lower rail for substantially sealing the space between the aperture and passage;

said manifold also having an outside air receiving opening positioned above the upper surface of the hearth;

said manifold being of generally rectangular box-like construction, said manifold having first and second end walls and the outside air receiving opening being defined by the first end wall, said device including a first conduit fastened to said first end wall and communicating with the interior of the manifold through the outside air receiving opening, said first conduit being adapted for connection to an additional conduit in communication with an outside area so that outside combustion air is permitted to flow through the additional conduit, the first conduit, the outside in receiving opening and into the manifold, said support means comprising at least two mounting brackets removably connected at a lower end portion to said wall and having a hooked upper end portion for engaging the door track portion of the lower rail, said mounting brackets being reversible such that when in a first position they support the manifold so that the first conduit projects in one direction relative to the fireplace and when in a second position opposite the first position they support the manifold so that the first conduit projects in the opposite direction relative to the fireplace.

* * * * *